US009722724B1

(12) United States Patent
Singleton et al.

(10) Patent No.: US 9,722,724 B1
(45) Date of Patent: Aug. 1, 2017

(54) ANTENNA AND TRANSCEIVER FOR TRANSMITTING A SECURE SIGNAL

(71) Applicant: LOS ALAMOS NATIONAL SECURITY, LLC, Los Alamos, NM (US)

(72) Inventors: John Singleton, Los Alamos, NM (US); Andrea Schmidt, Los Alamos, NM (US)

(73) Assignees: Los Alamos National Security, LLC, Los Alamos, NM (US); Los Alamos National Laboratory LC/TAS

( * ) Notice: Subject to any disclaimer, the term of this patent is extended or adjusted under 35 U.S.C. 154(b) by 0 days.

(21) Appl. No.: 15/380,893

(22) Filed: Dec. 15, 2016

Related U.S. Application Data

(60) Provisional application No. 62/329,884, filed on Apr. 29, 2016.

(51) Int. Cl.
*H04K 1/00* (2006.01)
*H04K 3/00* (2006.01)

(52) U.S. Cl.
CPC ..... *H04K 3/28* (2013.01); *H04K 3/44* (2013.01); *H04K 3/86* (2013.01)

(58) Field of Classification Search
USPC ..... 455/1, 550.1, 73, 91
See application file for complete search history.

(56) References Cited

U.S. PATENT DOCUMENTS 8,125,385 B2 * 2/2012 Singleton ..... H01Q 3/34 342/374
2010/0015918 A1 * 1/2010 Liu ..... H04B 5/00 455/41.1

* cited by examiner

*Primary Examiner* — Fayyaz Alam
(74) *Attorney, Agent, or Firm* — Lewis Roca Rothgerber Christie LLP

(57) ABSTRACT

An accelerated superluminal polarization currents (ASPC) transceiver includes an ASPC transmitter including a plurality of ASPC radiator elements, the ASPC transmitter transmitting a radio signal that is focused in a target direction and scrambled in other directions; and a radio receiver, wherein the center of a pulse of the radio signal has a transit time $t_c$ from an end of the ASPC transmitter, at a first position $-x_0$, to a second position x along the ASPC transmitter given by the following equation: $t_c=[R^2+x_0^2+2Rx_0 \cos \psi_0]^{1/2}-[R^2+x^2+2Rx \cos \psi_0]^{1/2}$, where R is a target distance from the ASPC transmitter and $\psi_0$ is a target angle and $$\frac{x+x_0}{t_c} > c.$$

20 Claims, 8 Drawing Sheets

ANTENNA AND TRANSCEIVER FOR TRANSMITTING A SECURE SIGNAL

CROSS-REFERENCE TO RELATED APPLICATION

This application claims the benefit of U.S. Provisional Patent Application Ser. No. 62/329,884, filed Apr. 29, 2016, the contents of which are hereby incorporated by reference in its entirety.

STATEMENT REGARDING FEDERALLY SPONSORED RESEARCH OR DEVELOPMENT

The United States government has rights in this invention pursuant to Contract No. DE-AC52-06NA25396 between the United States Department of Energy and Los Alamos National Security, LLC for the operation of Los Alamos National Laboratory.

BACKGROUND AND SUMMARY

1. Field

Embodiments of the present invention relate to the transmission and receipt of electromagnetic signals, and in particular to secure radio communications.

2. Related Art and Summary

Soon after the introduction of wireless communication, it was realized that radio messages were vulnerable to interception and deciphering. Transmissions from conventional antennas using standard modulation schemes are vulnerable to eavesdropping.

It might be thought that the issue could in part be addressed by making a very directional antenna, so that the message is sent only in a specific direction. However, exactly the same modulation used to send the message will be present in the side lobes of the antenna and other stray emissions; with a sufficiently sensitive receiver, an eavesdropper can listen in directions different from the main beam. Encryption is a reasonable solution, but it demands that transmitter and receiver have access to the same key, with the attendant security issues that this brings.

Einstein's Special Relativity theory sets an upper bound for the transmission of electromagnetic radiation or matter at the speed of light in a vacuum. Although electromagnetic radiation itself is so constrained, a pattern of electric polarization can travel faster than the speed of light (i.e. superluminally, or supraluminally) by a coordinated motion of the charged particles. Experiments performed at Oxford University and at Los Alamos National Laboratory established that polarization currents can travel faster than the speed of light.

A device configured to produce superluminal polarization currents may include a plurality of pairs or sets of electrodes, with dielectric separating the electrodes of each pair. The superluminal polarization current emits electromagnetic radiation, so that devices can be used as broadcasting antennas. Each set of electrodes and the dielectric between them acts as an antenna element. Since the polarization current radiates, the dielectric between the electrodes acts as a radiator element of the antenna.

According to some aspects, embodiments of the present invention may enable information to be received and understood in a particular direction between a radio transmitter and a receiver operated by a desired recipient. In other directions the information may be scrambled into an incomprehensible form, reducing the possibility of eavesdropping.

According to some aspects, embodiments of the present invention may enable information to be received and understood in a particular direction and at a particular distance between a radio transmitter and a receiver operated by a desired recipient. In other directions and at other distances the information may be scrambled into an incomprehensible form, reducing the possibility of eavesdropping.

According to an embodiment of the present invention, an accelerated superluminal polarization currents (ASPC) transceiver includes an ASPC transmitter including a plurality of ASPC radiator elements, the ASPC transmitter transmitting a radio signal that is focused in a target direction and scrambled in other directions; and a radio receiver, wherein the center of a pulse of the polarization-current signal has a transit time $t_c$ from an end of the ASPC transmitter, at a first position $-x_0$, to a second position x along the ASPC transmitter given by the following equation:

$$t_c=[R^2+x_0^2+2Rx_0\cos\psi_0]^{1/2}-[R^2+x^2+2Rx\cos\psi_0]^{1/2},$$

where R is a target distance from the ASPC transmitter and $\psi_0$ is a target angle.

In variations of the embodiments described below, the plurality of ASPC radiator elements may each include a dielectric element; and a pair of electrodes, one on each side of the dielectric element. The plurality of ASPC radiator elements may each further include a connector for connecting a controller to the pair of electrodes; and wiring between the connector and the pair of electrodes. The plurality of ASPC radiator elements may each further include an insulating support structure housing the pair of electrodes, the dielectric element, the connector, and the wiring.

In other variations of the embodiments described below, application of correctly timed voltages to the connectors of the plurality of ASPC radiator elements may cause a polarization current in the dielectric elements of the plurality of ASPC radiator elements to move superluminally. In the example ASPC transceiver, $$\frac{x+x_0}{t_c}$$

is greater than c, where c is the speed of light. The ASPC transmitter may further transmit the radio signal such that the radio signal is focused at a target distance and scrambled at other distances.

According to another embodiment of the present invention, a radio communication system includes a plurality of accelerated superluminal polarization currents (ASPC) transceivers, wherein each ASPC transceiver of the plurality of ASPC transceivers transmits a radio signal that is received by a target one of the plurality of ASPC transceivers that is in a target direction, and wherein the radio signal is scrambled in directions other than the target direction. Each ASPC transceiver of the plurality of ASPC transceivers may include an ASPC transmitter including a plurality of ASPC radiator elements; and a radio receiver. The plurality of ASPC radiator elements may each include a dielectric element; and a pair of electrodes, one on each side of the dielectric element. The plurality of the ASPC radiator elements may each further include a connector for connecting a controller to the pair of electrodes; and wiring between the connector and the pair of electrodes. The plurality of ASPC radiator elements may each further include an insulating support structure housing the pair of electrodes, the dielectric element, the connector, and the wiring.

In variations of the embodiments described below, application of correctly timed voltages to the connectors of the plurality of ASPC radiator elements may cause a polarization current in the dielectric elements of the plurality of ASPC radiator elements to move superluminally. In the example radio communication system, $$\frac{x+x_0}{t_c}$$

is greater than c, where c is the speed of light.

The ASPC transmitter may transmit the radio signal such that the radio signal is focused at a target distance and scrambled at other distances. The center of a pulse of the radio signal may have a transit time $t_c$ from an end of the ASPC transmitter, at a first position $-x_0$, to a second position x along the ASPC transmitter given by the following equation:

$$t_c=[R^2+x_0^2+2Rx_0\cos\psi_0]^{1/2}-[R^2+x^2+2Rx\cos\psi_0]^{1/2},$$

where R is a target distance from the ASPC transmitter and $\psi_0$ is a target angle. According to another embodiment of the present invention, a method of transmitting a radio signal via an accelerated superluminal polarization currents (ASPC) antenna includes applying, respectively, a plurality of voltages to a plurality of electrodes of the ASPC antenna, the plurality of voltages being applied with a coordinated voltage and timing such that the radio signal is transmitted in a target direction and scrambled in other directions, wherein the center of a pulse of the radio signal has a transit time $t_c$ from an end of the antenna, at a first position $-x_0$, to a second position x along the antenna given by the following equation:

$$t_c=[R^2+x_0^2+2Rx_0\cos\psi_0]^{1/2}-[R^2+x^2+2Rx\cos\psi_0]^{1/2},$$

where R is a target distance from the ASPC antenna and $\psi_0$ is a target angle. In the example method described below, $$\frac{x+x_0}{t_c}$$

is greater man c, where c is the speed of light. The coordinated voltage and timing may be such that a component of a velocity of a polarization current in the ASPC antenna in the target direction is always the speed of light. The plurality of voltages may vary with position as well as time.

These and other features and advantages of the various embodiments of the present invention are described in detail below with reference to the following figures.

DETAILED DESCRIPTION OF THE PREFERRED AND EXAMPLE EMBODIMENTS

As described herein, a preferred transmitter, transceiver, and method for transmitting electromagnetic signals can include antennas having accelerated superluminal polarization current (ASPC) to generate and radiate the signal. Unlike conventional radiation delivery systems, including for example radio communications systems, the physical characteristics of the preferred and example embodiments render the signal coherent at only one point in space, and scrambled in both time and space at all other points. Therefore the claimed invention can provide physics-based security to both communications as well as other modalities of electromagnetic transmission. These and other features and advantages of the preferred polarization-current accelerator and accelerator cell are illustrated below.

Embodiments of the present invention can include an antenna comprising an ASPC. Embodiments of the present invention utilize an acceleration scheme for such an antenna that allows it to send chirped signals or signals modulated in other ways that are only comprehensible in one direction and that are scrambled in other directions. As such, a signal may be sent to a known location of the desired recipient and may also be understandable only in that direction.

It is well known that matter and energy cannot travel faster than c, the speed of light in vacuo. However, it has been shown that a series of dielectric elements can be excited in sequence such that a polarization-current distribution (e.g., a chirp, wave or pulse) moves through the series of dielectric elements superluminally (i.e., faster than c). Maxwell's equations show that superluminal polarization-current distributions emit radiation.

The unique attributes of ASPCs as sources of electromagnetic radiation that make them useful in the current context are as follows: (i) they are true volume sources in that the "signal" to be transmitted exists over the entire volume of the dielectric part of the antenna, rather than at a series of points or lines (as would be the case in a phased array); and (ii) because the source travels faster than the radiation that it emits, there is no simple correspondence between reception time and retarded times.

Attribute (i) means that there are destructive and constructive interference mechanisms possible in antennas based on ASPC that do not exist in phased arrays. Along with attribute (ii), these form the basis of signal scrambling in both space and time, which can in turn provide a large measure of information security.

Figure 1:
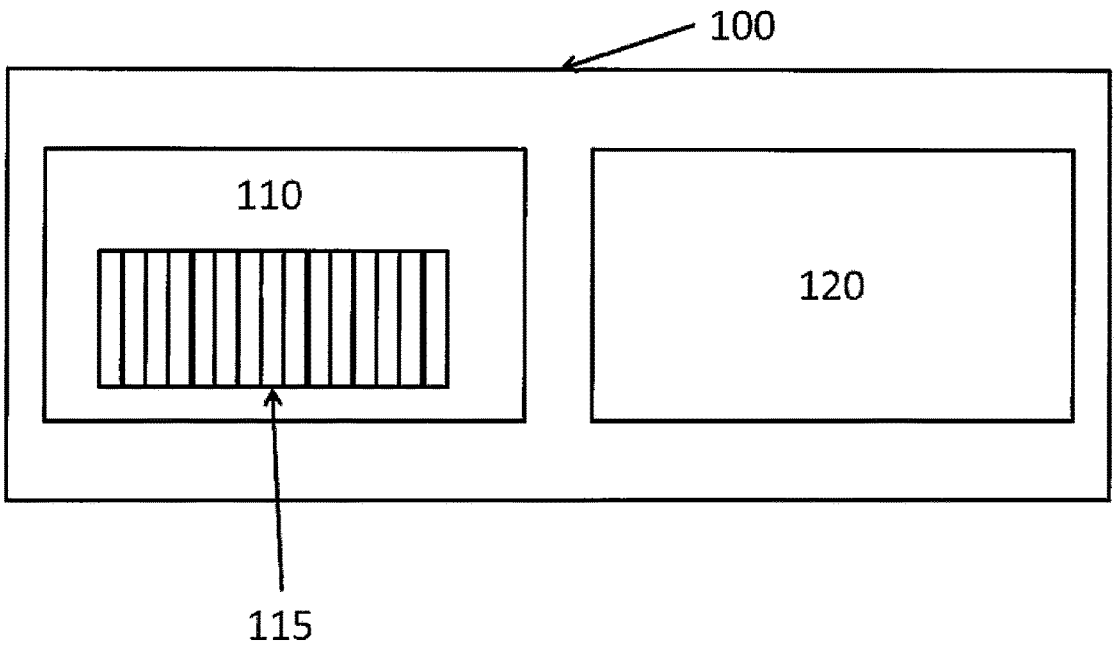
FIG. 1 illustrates an accelerated superluminal polarization currents (ASPC) transceiver according to an embodiment of the present invention.

FIG. 1 illustrates an ASPC transceiver 100 according to an embodiment of the present invention. The ASPC transceiver 100 includes an ASPC transmitter 110 including a plurality of ASPC radiator elements 115, the ASPC transmitter 110 transmitting a radio signal 210 (see FIG. 2) that is focused in a target direction D (see FIG. 2) and scrambled in other directions; and a radio receiver 120. The center of a pulse of the radio signal 210 has a transit time $t_c$ from an end of the ASPC transmitter 110, at a first position $-x_0$, to a second position x along the ASPC transmitter 100 given by the following equation:

$$t_c=[R^2+x_0^2+2Rx_0\cos\psi_0]^{1/2}-[R^2+x^2+2Rx\cos\psi_0]^{1/2}, \quad \text{Equation 1:}$$

where R is a target distance from the ASPC transmitter 110 and $\psi_0$ is a target angle.

According to an embodiment of the present invention, a target may be situated at a distance from the center of the array of dielectric elements of a linear ASPC antenna. The target may make an angle $\psi_0$ with the long (x) axis of the antenna. The antenna has a length $2x_0$, and is centered on x=0. The plurality of ASPC radiator elements 115 may each include a dielectric element; and a pair of electrodes, one on each side of the dielectric element. The plurality of ASPC radiator elements 115 may each further include a connector for connecting a controller to the pair of electrodes; and wiring between the connector and the pair of electrodes. The plurality of ASPC radiator elements 115 may each further include an insulating support structure housing the pair of electrodes, the dielectric element, the connector, and the wiring. Application of correctly timed voltages to the connectors of the plurality of ASPC radiator elements 115 may cause a polarization current in the dielectric elements of the plurality of ASPC radiator elements 115 to move superluminally. The ASPC transmitter 110 may further transmit the radio signal 210 such that the radio signal 210 is focused at a target distance and scrambled at other distances. In the example ASPC transceiver 100, $$\frac{x+x_0}{t_c}>c,$$

where c is the speed of light.

In one example embodiment of the present invention, the accelerated superluminal polarization currents (ASPC) transceiver 100 includes a superluminal antenna employing accelerated superluminal polarization currents (ASPCs). The antenna may include thirty-two radiator elements 115 made from a dielectric placed between a pair of metal electrodes. A voltage applied between the electrodes induces polarization in the dielectric. Voltages may be fed to the electrodes from a set of SMA connectors via stripline feeds that also provide impedance matching. A polarization current may be made to move superluminally along the array of dielectric elements by applying voltage signals to the SMA connectors with appropriate time delays or phase shifts.

According to an embodiment of the present invention, the superluminal antenna may include support structures (e.g., a glass-fiber/epoxy composite support structure such as G10 or 10G40). The support structure may be any suitable electrical insulator. Thirty-two pairs of metal electrodes may be mounted on the support structures on either side of the dielectric. A voltage difference applied across an electrode pair will polarize the dielectric in between. Each electrode pair may be connected via a stripline feed to an SMA connector. The application of correctly timed voltages to the SMA connectors will cause the polarization current to move superluminally. A superluminally moving polarization current emits electromagnetic radiation.

While example embodiments of the present invention are described with a linear ASPC antenna, the present invention is not limited thereto and any suitable configurations of ASPC antennas may be used (e.g., a circular or arced ASPC antenna). Further, while example embodiments of the present invention are described with SMA connectors, the present invention is not limited thereto and any suitable connectors may be used, or connectors may be omitted (e.g., directly wired).

According to embodiments of the present invention, the antenna may be formed in such a way as to prevent emission out of the back of the antenna. The back of the antenna may include components used for impedance matching between the signal feeds and the electrodes. These components may be optimized to transmit signals from the feed to the electrodes, and may also prevent any radiation traveling back in the opposite direction from the target direction.

A polarization-current chirp moves along the dielectric elements of the ASPC antenna. The component of the polarization-current's velocity towards the target is always c, the speed of light. For this to occur, the center of the chirp may have a transit time $t_c$ from the end of the antenna (position $-x_0$) to position x along the antenna given by Equation 1 above.

The polarization current may be controlled by providing carefully timed voltages that may have voltages that vary with position along the antenna as well as time. Further, the timing and magnitude of the voltages may be actively controlled (e.g., using a suitable controller), or may be passively controlled (e.g., using wires or interconnects of different lengths). Actively controlling the timing and magnitude of the voltages may allow for changes in the target angle of the ASPC antenna, whereas passively controlling the timing and magnitude of the voltages may allow for a fixed target angle of the ASPC antenna.

Figure 2:
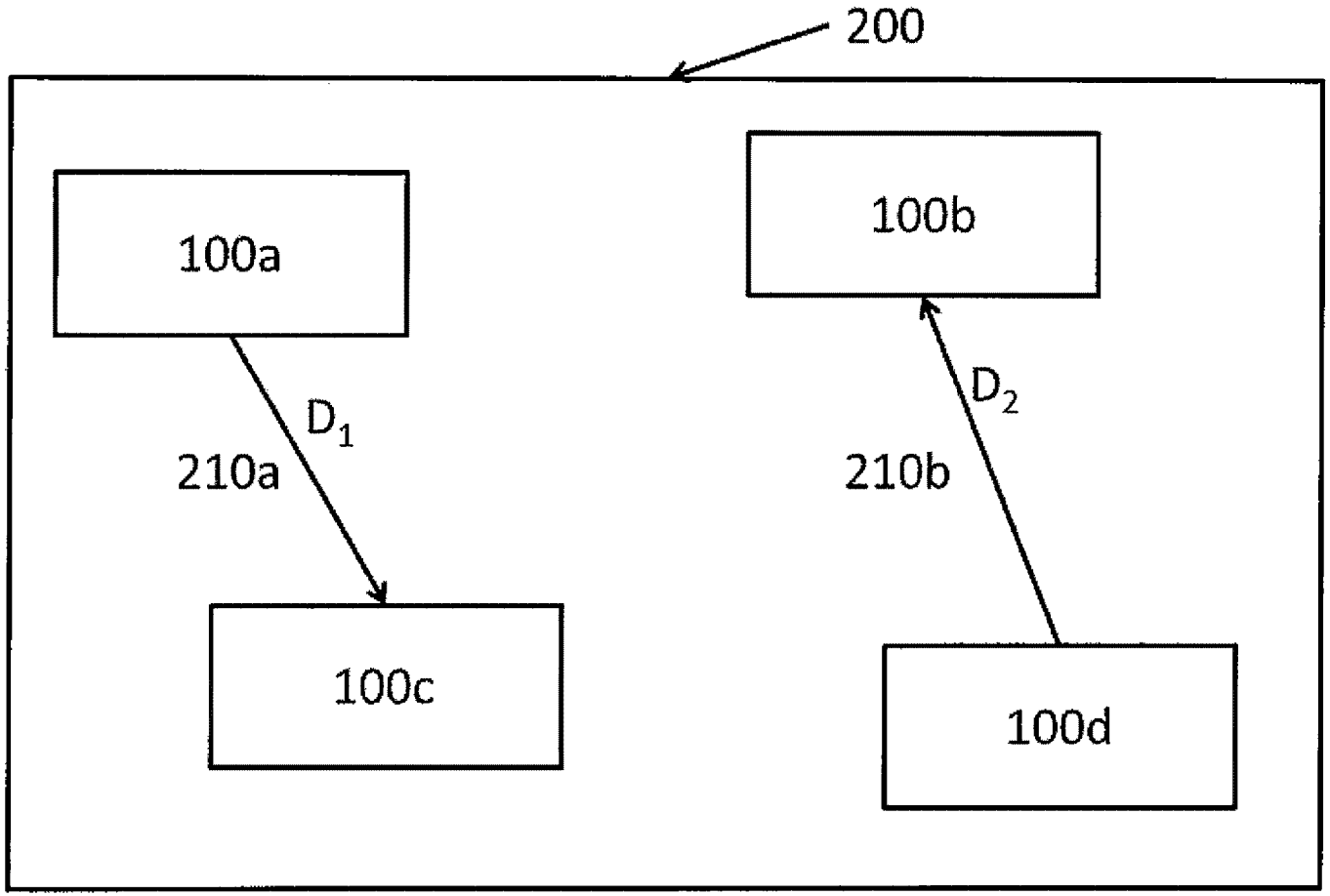
FIG. 2 illustrates a radio communication system according to another embodiment of the present invention.

FIG. 2 illustrates a radio communication system 200 according to an embodiment of the present invention. The radio communication system 200 includes a plurality of accelerated superluminal polarization currents (ASPC) transceivers 100 (100*a*, 100*b*, 100*c*, 100*d*), wherein each ASPC transceiver 100 of the plurality of ASPC transceivers 100 transmits a radio signal 210 (210*a*, 210*b*) that is received by a target one of the plurality of ASPC transceivers 100 that is in a target direction D ($D_1$, $D_2$), and wherein the radio signal 210 is scrambled in directions other than the target direction D.

By way of example, ASPC transceiver 100*c* may be located in a direction $D_1$ from the ASPC transceiver 100*a*. When the ASPC transceiver 100*a* emits a signal 210*a* with a target direction $D_1$, ASPC transceiver 100*c* may receive the signal unscrambled, but ASPC transceivers 100*b* and 100*d*, which are not located in the target direction $D_1$ from the ASPC transceiver 100*a*, would receive a scrambled signal. Likewise, ASPC transceiver 100*b* may be located in a direction $D_2$ from the ASPC transceiver 100*d*. When the ASPC transceiver 100*d* emits a signal 210*b* with a target direction $D_2$, ASPC transceiver 100*b* may receive the signal unscrambled, but ASPC transceivers 100*a* and 100*c*, which are not located in the target direction $D_2$ from the ASPC transceiver 100*d*, would receive a scrambled signal.

Further, each ASPC transceiver 100 of the plurality of ASPC transceivers 100 may include an ASPC transmitter 110 including a plurality of ASPC radiator elements 115; and a radio receiver 120. The plurality of ASPC radiator elements 115 may each include a dielectric element; and a pair of electrodes, one on each side of the dielectric element. The plurality of the ASPC radiator elements 115 may each further include a connector for connecting a controller to the pair of electrodes; and wiring between the connector and the pair of electrodes. The plurality of ASPC radiator elements 115 may each further include an insulating support structure housing the pair of electrodes, the dielectric element, the connector, and the wiring. Application of correctly timed voltages to the connectors of the plurality of ASPC radiator elements 115 may cause a polarization current in the dielectric elements of the plurality of ASPC radiator elements 115 to move superluminally. The ASPC transmitter 110 may transmit the radio signal 210 such that the radio signal 210 is focused at a target distance and scrambled at other distances. The center of a pulse of the radio signal 210 may have a transit time $t_c$ from an end of the ASPC transmitter 110, at a first position $-x_0$, to a second position x along the ASPC transmitter 110 given by equation 1 above, where $$\frac{x+x_0}{t_c} > c,$$

where c is the speed of light.

An example method of transmitting a radio signal 210 via an accelerated superluminal polarization currents (ASPC) antenna starts at 300. A controller, such as a communications controller, processor, FPGA, integrated circuit, special purpose computer, or any other suitable controller applies, at 310, respectively, a plurality of voltages to a plurality of electrodes of the ASPC antenna, the plurality of voltages being applied with a coordinated voltage and timing such that the radio signal 210 is transmitted in a target direction D and scrambled in other directions, wherein the center of a pulse of the radio signal 210 has a transit time $t_c$ from an end of the antenna, at a first position $-x_0$, to a second position x along the antenna given by equation 1 above, where $$\frac{x+x_0}{t_c} > c,$$

where c is the speed of light.

The coordinated voltage and timing may be such that a component of a velocity of a polarization current in the ASPC antenna in the target direction D is always the speed of light. The plurality of voltages may vary with position as well as time.

The following discussion of particular example embodiments includes results derived from a specific configuration of the embodiments of the present invention. It will be understood by those of skill in the art that the following discussion is not limiting in any fashion, but merely serves as an illustration of the features and advantages of the claimed invention.

Figure 4A:
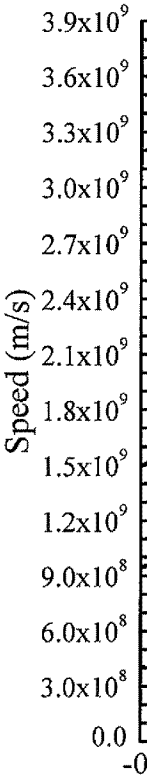
FIGS. 4A and 4B illustrate plots of chirp speed versus distance along the ASPC antenna for three different choices of target angle $\psi_0$ and two choices of target focus distance in accordance with one example configuration of the present invention.
Figure 4B:
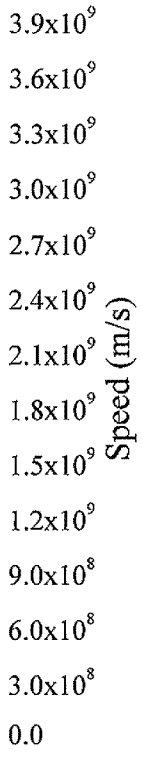

FIGS. 4A and 4B illustrate plots of chirp speed versus distance along the ASPC antenna for three different choices of target angle $\psi_0$ and two choices of target focus distance, shown in the inset key. In FIG. 4*a* the target distance is set as R=5 m and in FIG. 4B. the target distance is set as R=20 m. The target distances were chosen to make the acceleration easier to recognize in the plots. It can be seen from Equation 1 that values of $\psi_0$ closer to 90° will require higher speeds. Further, the target distance is set by the acceleration. Focus distances may be limited by the precision of the phase settings for the voltages applied to the SMA connectors.

A polarization current $J_p$ for a chirp may be described by Equation 2, where $J_0$ is the maximum polarization current, $\alpha$ is the width parameter of the chirp, t is the time, and $\omega$ is angular frequency ($2\pi$ times the frequency f).

$$J_P = J_0 e^{-\alpha^2(t-t_c)^2} \cos[\omega(t-t_c)] \qquad \text{Equation 2:}$$

Figure 6:
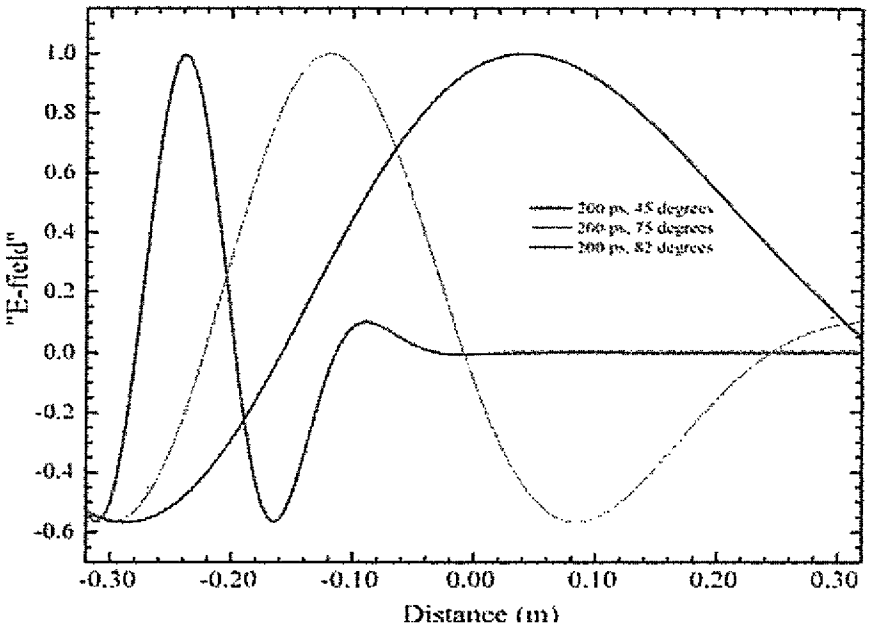
FIG. 6 illustrates a chirp shown at $t_c$=200 ps for the speeds shown in FIG. 4*a* in accordance with one example configuration of the present invention.
Figure 5:
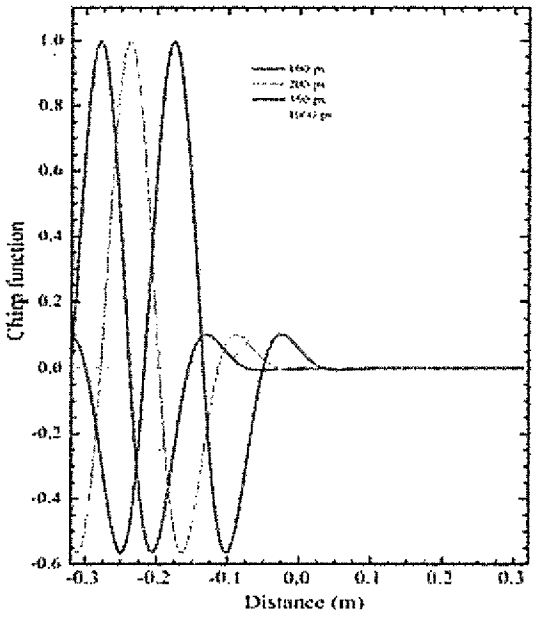
FIG. 5 illustrates a chirp with frequency f=2.5 GHz and width parameter $\alpha$=1/(2 GHz), plotted as polarization current versus distance x along the ASPC antenna in accordance with one example configuration of the present invention.

FIG. 5 illustrates a chirp with frequency f=2.5 GHz and width parameter $\alpha$=1/(2 GHz), plotted as polarization current versus distance x along the ASPC antenna. The chirp is shown at the times $t_c$ given in the key (see Equation 1). Here, the center speed is quite slow, averaging about 1.4c (corresponding to the 45° focus in FIG. 4). FIG. 6 illustrates a chirp shown at $t_c$=200 ps for the speeds shown in FIG. 4 (see inset key for corresponding target $\psi_0$ values).

Referring to FIGS. 5 and 6, a typical shape is shown in FIG. 5 for $\omega/2\pi$=f=2.5 GHz and $\alpha=5\times10^8$ s. As the speed increases, less and less of the chirp is in the antenna at any one time. Emitted light (i.e., electromagnetic radiation) that travels in the target direction collapses to a point in time making it possible for the information to be collected. Emitted light (i.e., electromagnetic radiation) that travels in other directions is scrambled and the information cannot be collected. As can be seen in FIGS. 5 and 6, according to some embodiments of the present invention, the ASPC antenna may not have an entire chirp signal therein at a given time.

Figure 7:
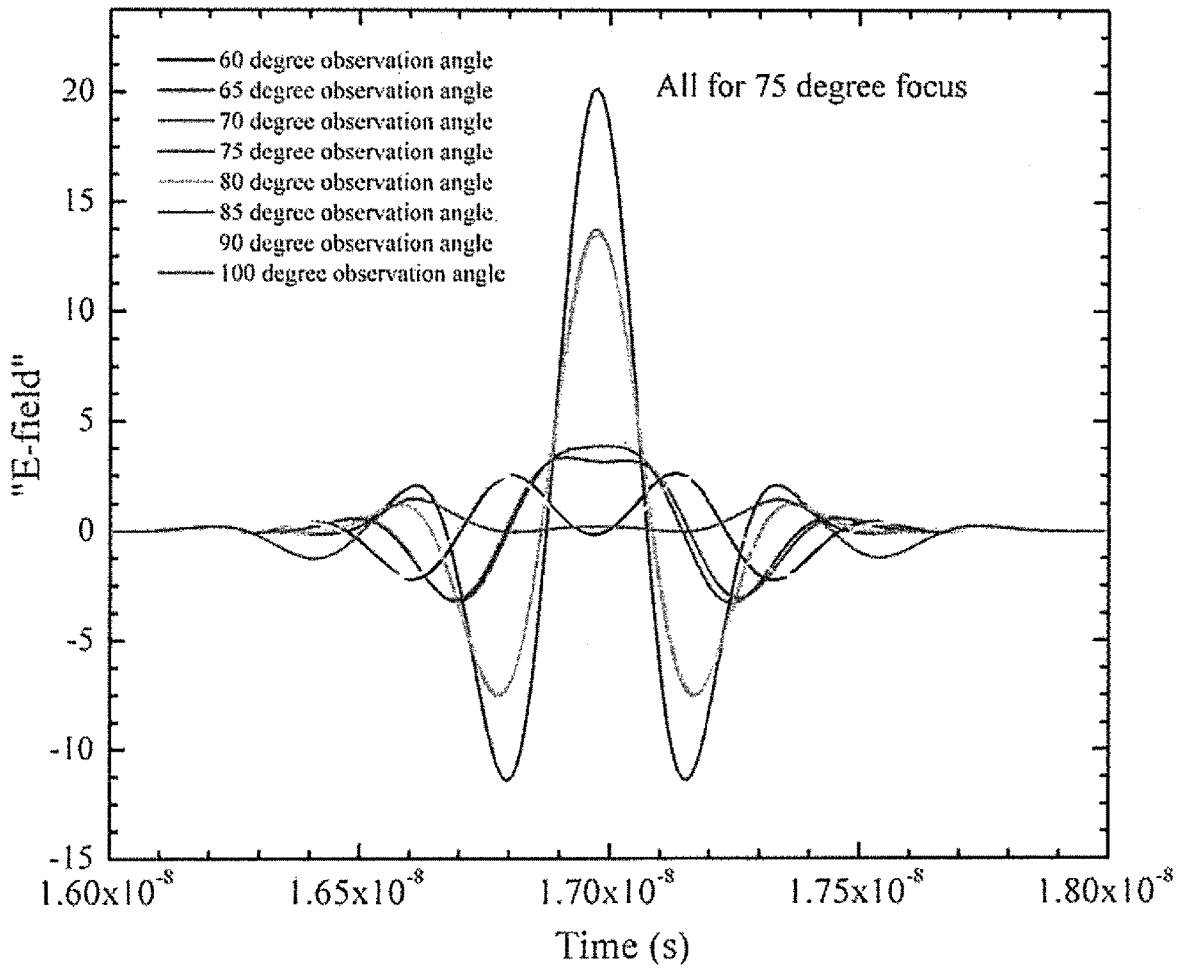
FIG. 7 illustrates a chirp signal received versus time for a detector placed at various angles $\psi$ to the long (x) axis of the ASPC antenna in accordance with one example configuration of the present invention.

FIG. 7 illustrates a chirp signal received versus time for a detector placed at various angles $\psi$ (see inset key) to the long (x) axis of the ASPC antenna. In FIG. 7, the set focus angle is $\psi_0$=75° (e.g., the target angle $\psi_0$). The signal received at an angle $\psi$ (not necessarily equal to $\psi_0$) can be calculated. FIG. 7 shows some typical results. At the target angle ($\psi=\psi_0$=75°), the chirp is reproduced exactly. As $\psi$ moves away from the target angle $\psi_0$, the chirp is distorted and eventually becomes unrecognizable, and additionally, the frequency content changes.

Figure 8:
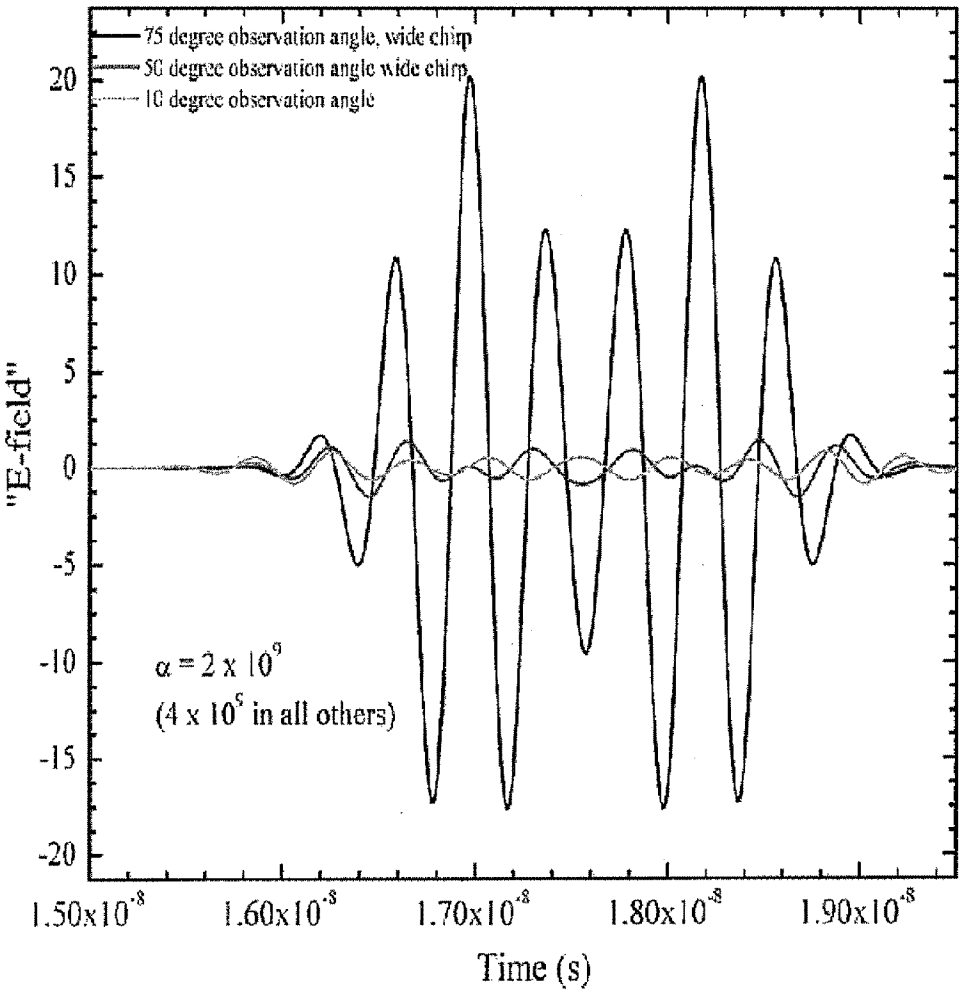
FIG. 8 illustrates a double chirp signal received versus time for a detector placed at various angles $\psi$ to the long (x) axis of the ASPC antenna in accordance with one example configuration of the present invention.

FIG. 8 illustrates a double chirp signal received versus time for a detector placed at various angles $\psi$ (see inset key) to the long (x) axis of the ASPC antenna. In FIG. 8, the set focus angle is $\psi_0$=75° (e.g., the target angle $\psi_0$), $\omega/2\pi$=f=2.5 GHz, $\alpha=2\times10^8$ s, and the chirps are spaced in time by 3/f. The correct modulation of the chirp is observable at the target angle $\psi_0$=75°, but is lost quickly as one moves away in angle. As can be seen in FIG. 8, an ASPC antenna can be used according to embodiments of the present invention to transmit a signal that is only understandable over a small region and scrambled elsewhere. Further, as the angle varies further from the target angle $\psi_0$, the two chirps blend together and it becomes increasingly difficult to distinguish one chirp from another. When information is sent as a series of pulses, the blending of the pulses increases the effect of off-angle scrambling.

Figure 9:
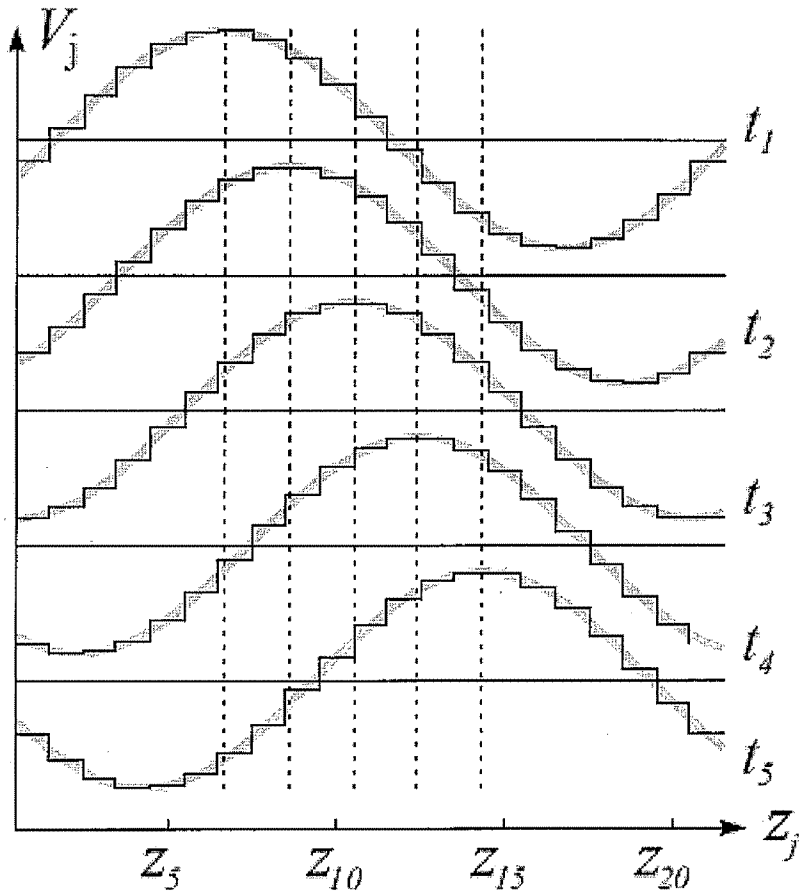
FIG. 9 is a graph illustrating voltage vs position for five equally spaced points in time in accordance with one example configuration of the present invention.

FIG. 9 is a graph illustrating voltage vs position for five equally spaced points in time. The graph illustrates the voltage $V_j$ (see Equation 3) applied to each electrode pair versus the z coordinate $z_j$ (where j is a natural number) of the center of the $j^{th}$ electrode at five equally-spaced consecutive times $t_1$, $t_2$, $t_3$, $t_4$, and $t_5$ (where $t_1<t_2<t_3<t_4<t_5$). The vertical dotted lines illustrate the locations at which Vj is maximum at each of the consecutive times $t_1$, $t_2$, $t_3$, $t_4$, and $t_5$. The sinusoidal curves represent a fundamental Fourier component of a discretized voltage distribution at various times. The constant phase difference between adjacent elements results in propagation of the sinusoidal voltage distribution at a constant speed. Superluminal speeds can be imparted to a polarization current using appropriately spaced signals sent to each electrode. The center-to-center spacing of the electrodes is a. A travelling sinusoidal polarization distribution when the $j^{th}$ electrode pair of the array is supplied with a voltage $V_j$ according to Equation 3.

$$V_j = V_0 \cos[\eta(j\Delta t - t)] \quad \text{Equation 3:}$$

Voltages $V_j$ are usually such that alumina behaves as a linear dielectric, so that the polarization P in the $j^{th}$ element will be proportional to $V_j$.

FIG. 9 shows how the first cosine term in Equation 3 results in propagation of the voltage, and hence the polarization, along the array. The speed v with which the polarization current distribution propagates is set by adjusting $\Delta t$ to give $v=a/\Delta t$. Acceleration of the polarization current can be implemented by allowing $\Delta t$ (see Equation 3) to vary along the length of the array. According to some embodiments of the present invention, ASPC antennas may transmit radio waves (e.g., radio waves in the atmospheric window or radio window). Further, according to some embodiments of the present invention, ASPC antennas may transmit radio waves with frequencies of about 1-5 GHz. According to some embodiments of the present invention, the modulation may be fast and signals may be broadband (e.g., sent over a broad spectrum of frequencies) compared to current telecommunications which are over a single frequency or limited frequency ranges. According to embodiments of the present invention, bandwidth overload may be avoided by transmitting information quickly and directionally.

It will be understood that, although the terms "first," "second," "third," etc., may be used herein to describe various elements, components, regions, layers, and/or sections, these elements, components, regions, layers, and/or sections should not be limited by these terms. These terms are used to distinguish one element, component, region, layer, or section from another element, component, region, layer, or section. Thus, a first element, component, region, layer, or section discussed below could be termed a second element, component, region, layer, or section without departing from the spirit and scope of the present invention.

Figure 3:
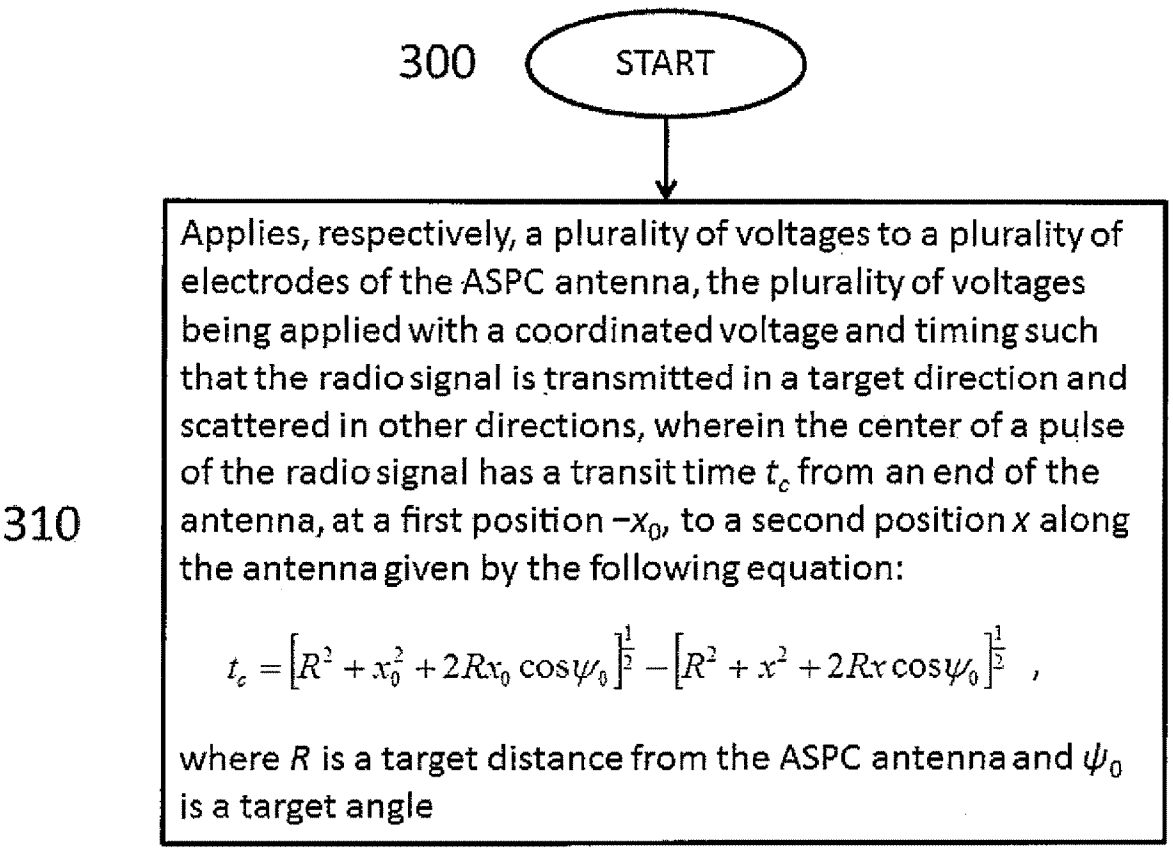
FIG. 3 illustrates a method of transmitting a radio signal via an accelerated superluminal polarization currents (ASPC) antenna according to another embodiment of the present invention.

A relevant device or component (or relevant devices or components) according to embodiments of the present invention described herein may be implemented utilizing any suitable hardware (e.g., an application-specific integrated circuit), firmware (e.g., a DSP or FPGA), software, or a suitable combination of software, firmware, and hardware. For example, the various components of the relevant device(s), such as the communications controller that implements in part the example method described with reference to FIG. 3, may be formed on one integrated circuit (IC) chip separate IC chips. Further, the various components of the relevant device(s) may be implemented on a flexible printed circuit film, a tape carrier package (TCP), a printed circuit board (PCB), or formed on a same substrate as one or more circuits and/or other devices. Further, the various components of the relevant device(s) may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Spatially relative terms, such as "top," "bottom," "beneath," "below," "lower," "under," "above," "upper," and the like, may be used herein for ease of description to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below," "beneath," or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

Further, it will also be understood that when one element, component, region, layer, and/or section is referred to as being "between" two elements, components, regions, layers, and/or sections, it can be the only element, component, region, layer, and/or section between the two elements, components, regions, layers, and/or sections, or one or more intervening elements, components, regions, layers, and/or sections may also be present.

The terminology used herein is for the purpose of describing particular embodiments and is not intended to be limiting of the present invention. As used herein, the singular forms "a" and "an" are intended to include the plural forms as well, unless the context clearly indicates otherwise. It will be further understood that the terms "comprise," "comprises," "comprising," "includes," "including," and "include," when used in this specification, specify the presence of stated features, integers, steps, operations, elements, and/or components, but do not preclude the presence or addition of one or more other features, integers, steps, operations, elements, components, and/or groups thereof.

As used herein, the term "and/or" includes any and all combinations of one or more of the associated listed items. Further, the use of "may" when describing embodiments of the present invention refers to "one or more embodiments of the present invention."

It will be understood that when an element or layer is referred to as being "on," "connected to," "coupled to," "connected with," "coupled with," or "adjacent to" another element or layer, it can be "directly on," "directly connected to," "directly coupled to," "directly connected with," "directly coupled with," or "directly adjacent to" the other element or layer, or one or more intervening elements or layers may be present. Furthermore, "connection," "connected," etc., may also refer to "electrical connection," "electrically connected," etc., depending on the context in which such terms are used as would be understood by those skilled in the art. When an element or layer is referred to as being "directly on," "directly connected to," "directly coupled to," "directly connected with," "directly coupled with," or "immediately adjacent to" another element or layer, there are no intervening elements or layers present.

As used herein, "substantially," "about," and similar terms are used as terms of approximation and not as terms of degree, and are intended to account for the inherent deviations in measured or calculated values that would be recognized by those of ordinary skill in the art.

As used herein, the terms "use," "using," and "used" may be considered synonymous with the terms "utilize," "utilizing," and "utilized," respectively.

Features described in relation to one or more embodiments of the present invention are available for use in conjunction with features of other embodiments of the present invention. For example, features described in a first embodiment may be combined with features described in a second embodiment to form a third embodiment, even though the third embodiment may not be specifically described herein.

Embodiments of the present invention may enable information to be received and understood in a particular direction between a radio transmitter and a receiver operated by a desired recipient. In other directions the information may be scrambled into an incomprehensible form, reducing the possibility of eavesdropping.

Although this invention has been described with regard to certain specific embodiments, those skilled in the art will have no difficulty devising variations of the described embodiments, which in no way depart from the scope and spirit of the present invention. Furthermore, to those skilled in the various arts, the invention itself described herein will suggest solutions to other tasks and adaptations for other applications. It is the applicant's intention to cover by claims all such uses of the invention and those changes and modifications which could be made to the embodiments of the invention herein chosen for the purpose of disclosure without departing from the spirit and scope of the invention. Thus, the present embodiments of the invention should be considered in all respects as illustrative and not restrictive, the scope of the invention to be indicated by the appended claims and their equivalents.

What is claimed is:

1. An accelerated superluminal polarization currents (ASPC) transceiver comprising:

an ASPC transmitter comprising a plurality of ASPC radiator elements, the ASPC transmitter transmitting a radio signal that is focused in a target direction and scrambled in other directions; and a radio receiver, wherein the center of a pulse of the radio signal has a transit time $t_c$ from an end of the ASPC transmitter, at a first position $-x_0$, to a second position x along the ASPC transmitter given by the following equation:

$$t_c=[R^2+x_0^2+2Rx_0\cos\psi_0]^{1/2}-[R^2+x^2+2Rx\cos\psi_0]^{1/2},$$

where R is a target distance from the ASPC transmitter and $\psi_0$ is a target angle.

2. The ASPC transceiver of claim 1, wherein the plurality of ASPC radiator elements each comprise:

a dielectric element; and a pair of electrodes, one on each side of the dielectric element.

3. The ASPC transceiver of claim 2, wherein the plurality of ASPC radiator elements each further comprise:

a connector for connecting a controller to the pair of electrodes; and wiring between the connector and the pair of electrodes.

4. The ASPC transceiver of claim 3, wherein the plurality of ASPC radiator elements each further comprise an insulating support structure housing the pair of electrodes, the dielectric element, the connector, and the wiring.

5. The ASPC transceiver of claim 3, wherein application of correctly timed voltages to the connectors of the plurality of ASPC radiator elements will cause a polarization current in the dielectric elements of the plurality of ASPC radiator elements to move superluminally.

6. The ASPC transceiver of claim 1, wherein the ASPC transmitter further transmits the radio signal such that the radio signal is focused at a target distance and scrambled at other distances.

7. The ASPC transceiver of claim 1, where:

$$\frac{x+x_0}{t_c}>c,$$

where c is the speed of light.

8. A radio communication system comprising:

a plurality of accelerated superluminal polarization currents (ASPC) transceivers, wherein each ASPC transceiver of the plurality of ASPC transceivers transmits a radio signal that is received by a target of each of the plurality of ASPC transceivers that is in a target direction, and wherein the radio signal from each of the ASPC transceivers is scrambled in directions other than the target direction.

9. The radio communication system of claim 8, wherein each ASPC transceiver of the plurality of ASPC transceivers comprises:

an ASPC transmitter comprising a plurality of ASPC radiator elements; and a radio receiver.

10. The radio communication system of claim 9, wherein the plurality of ASPC radiator elements each comprise:

a dielectric element; and a pair of electrodes, one on each side of the dielectric element.

11. The radio communication system of claim 10, wherein the plurality of the ASPC radiator elements each further comprises:

a connector for connecting a controller to the pair of electrodes; and wiring between the connector and the pair of electrodes.

12. The radio communication system of claim 11, wherein the plurality of ASPC radiator elements each further comprise an insulating support structure housing the pair of electrodes, the dielectric element, the connector, and the wiring.

13. The radio communication system of claim 11, wherein application of correctly timed voltages to the connectors of the plurality of ASPC radiator elements will cause a polarization current in the dielectric elements of the plurality of ASPC radiator elements to move superluminally.

14. The radio communication system of claim 9, wherein the ASPC transmitter transmits the radio signal such that the radio signal is focused at a target distance and scrambled at other distances.

15. The radio communication system of claim 9, wherein the center of a pulse of the radio signal has a transit time $t_c$ from an end of the ASPC transmitter, at a first position $-x_0$, to a second position x along the ASPC transmitter given by the following equation:

$$t_c=[R^2+x_0^2+2Rx_0\cos\psi_0]^{1/2}-[R^2+x^2+2Rx\cos\psi_0]^{1/2},$$

where R is a target distance from the ASPC transmitter and $\psi_0$ is a target angle.

16. The radio communication system of claim 15, where:

$$\frac{x+x_0}{t_c}>c,$$

where c is the speed of light.

17. A method of transmitting a radio signal via an accelerated superluminal polarization currents (ASPC) antenna comprising:

at a communications controller, applying, respectively, a plurality of voltages to a plurality of electrodes of the ASPC antenna, the plurality of voltages being applied with a coordinated voltage and timing such that the radio signal is transmitted in a target direction and scrambled in other directions, wherein the center of a pulse of the radio signal has a transit time $t_c$ from an end of the antenna, at a first position $-x_0$, to a second position x along the antenna given by the following equation:

$$t_c=[R^2+x_0^2+2Rx_0\cos\psi_0]^{1/2}-[R^2+x^2+2Rx\cos\psi_0]^{1/2},$$

where R is a target distance from the ASPC antenna and $\psi_0$ is a target angle.

18. The method of claim 17, where:

$$\frac{x+x_0}{t_c}>c,$$

where c is the speed of light.

19. The method of claim 17, wherein the coordinated voltage and timing are such that a component of a velocity of a polarization current in the ASPC antenna in the target direction is always the speed of light.

20. The method of claim 17, wherein the plurality of voltages vary with position as well as time.

* * * * *